US008285171B2

(12) United States Patent
Morita

(10) Patent No.: US 8,285,171 B2
(45) Date of Patent: Oct. 9, 2012

(54) IMAGE FORMING APPARATUS HAVING A DUST PROOFING MEMBER FOR AN EXPOSURE DEVICE

(75) Inventor: Shinji Morita, Kunitachi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 968 days.

(21) Appl. No.: 11/940,859

(22) Filed: Nov. 15, 2007

(65) Prior Publication Data

US 2008/0317493 A1 Dec. 25, 2008

(30) Foreign Application Priority Data

Jun. 20, 2007 (JP) ..... 2007-162331

(51) Int. Cl.
*G03G 21/00* (2006.01)

(52) U.S. Cl. ..... 399/98

(58) Field of Classification Search ..... 399/98, 399/91, 107, 110, 111, 114, 118, 112
See application file for complete search history.

(56) References Cited

U.S. PATENT DOCUMENTS

| | | | | |
|---|---|---|---|---|
| 3,814,515 | A * | 6/1974 | Takahashi et al. | 399/98 |
| 4,703,334 | A * | 10/1987 | Mochimaru et al. | |
| 6,308,024 | B1 * | 10/2001 | Nakayama et al. | 399/98 |
| 6,324,350 | B1 * | 11/2001 | Ito et al. | |
| 2008/0025752 | A1 * | 1/2008 | Suyama et al. | 399/98 |

FOREIGN PATENT DOCUMENTS

| | | | |
|---|---|---|---|
| JP | 2-40541 | | 3/1990 |
| JP | 04181953 | A * | 6/1992 |
| JP | 6-317951 | | 11/1994 |
| JP | 07-232450 | | 9/1995 |
| JP | 2000-258968 | | 9/2000 |
| JP | 2000258968 | A * | 9/2000 |
| JP | 2002172814 | A * | 6/2002 |
| JP | 2003-084632 | | 3/2003 |
| JP | 2003084632 | A * | 3/2003 |
| JP | 2007293063 | A * | 11/2007 |
| JR | 2000-258968 | | 9/2000 |
| JR | 2003-54024 | | 2/2003 |

OTHER PUBLICATIONS

Japanese Office Action dated Apr. 21, 2009.
The First Office Action issued from the Chinese Patent Office, dated Mar. 9, 2011, in counterpart Chinese Application No. 200810127102.4 (4 pages).

* cited by examiner

*Primary Examiner* — Walter L Lindsay, Jr.
*Assistant Examiner* — Milton Gonzalez
(74) *Attorney, Agent, or Firm* — Finnegan, Henderson, Farabow, Garrett & Dunner, L.L.P.

(57) ABSTRACT

An image forming apparatus is disclosed. The image forming apparatus includes a photoconductor, an exposure device to expose the photoconductor, a dustproofing member arranged more upstream than an exposure position of the exposure device in a moving direction of the photoconductor, and a cover which supports the exposure device and dustproofing member. The cover opens around a pivot shaft which is arranged more upstream than the exposure device in the moving direction of the photoconductor.

2 Claims, 7 Drawing Sheets

IMAGE FORMING APPARATUS HAVING A DUST PROOFING MEMBER FOR AN EXPOSURE DEVICE

This application is based on Japanese Patent Application No. 2007-162331 filed on Jun. 20, 2007, with the Japanese Patent Office, the entire content of which is hereby incorporated by reference.

FIELD OF THE INVENTION

The present invention relates to an image forming apparatus employing an electro-photographic method.

BACKGROUND OF THE INVENTION

The image forming apparatus, employing the electro-photographic method, is an apparatus which forms a toner image by an electrical charge, subsequent exposure and development, and then transfers the formed image onto a recording member as a permanent image.

Since dried toner particles are used in the image forming apparatus employing the electro-photographic method, various problems occur due to dust, such as loosened toner particles, paper-sheet powder, and particles generated by electrical discharge.

Among various dusts in the apparatus, dust on an exposure section directly results in lower image quality, leading to various technologies being developed to prevent the exposure section from creating such dust.

Unexamined Japanese Patent Application Publication No. 6-317951 discloses that an aperture to introduce light rays is formed at the top of a frame, mounted on a laser emitting section of a laser exposure device, to support a dustproof glass, and that members positioned more upstream in the moving direction of a photoconductor are placed higher than members positioned more downstream in the moving direction of the photoconductor, so that air is prevented from flowing toward dustproof glass, whereby the particles, such as spattered toner, are prevented from landing on dustproof glass.

Unexamined Japanese Patent Application Publication No. 2000-258968 discloses an image forming apparatus in that an air regulating member to control airflows is mounted upstream of an exposure position in the moving direction of a photoconductor.

Unexamined Japanese Patent Application Publication No. 2003-054024 discloses an image forming apparatus in that a cover is provided which protrudes from the top of an LED head toward the upstream in the moving direction of the photoconductor, and said cover is declined to come close to the photoconductor toward the LED head.

Dustproofing members, disclosed in the above patent documents, effectively prevent dust from landing on the exposure device, however they are not effective to counter dust which has landed and accumulated on dustproofing members themselves. The above documents do not address this problem.

Most of the image forming apparatuses are structured so that their interior can be opened for maintenance or changing components of the photoconductor, as well as a charging device, an exposure device, a developing device, and a cleaning device, all being arranged around the photoconductor. As shown by the dashed lines in FIG. 2, some image forming apparatus are structured so that the photoconductor opens when the upper section is moved upward.

Since a laser-ray exposure device, being a complex structure, occupies much space in the image forming apparatus, said exposure device is mounted on the skeleton structure of the image forming apparatus. When the interior of the apparatus is open, most of the laser-ray exposure devices are not structured of movable sections.

On the other hand, when an LED (being a light emitting diode) exposure device is used in the image forming apparatus, said LED exposure device is preferably structured to be open by a cover.

In the above patent documents, dustproofing members are open with the exposure device, but the landed dust on dustproofing members drops onto the exposure device, whereby the exposure device becomes dusty, which is a major problem.

In order to clean the exposure device, long laborious hours are required.

SUMMARY OF THE INVENTION

The present invention has been achieved to overcome the above problem, and an object of the present invention is to provide an image forming apparatus in which the exposure device is prevented from coming dusty by the dust dropped from the dustproofing members, and maintenance is easily conducted.

The object can be attained by the items described below.

Item 1. An image forming apparatus, including:

a photoconductor, an exposure device to expose the photoconductor, a dustproofing member arranged upstream of an exposure position of the exposure device, in a moving direction of the photoconductor, and a cover which supports the exposure device and the dustproofing member, wherein said cover pivots on a shaft which is arranged upstream of the exposure position in the moving direction of the photoconductor.

Item 2. An image forming apparatus, including:

a photoconductor, an exposure device to expose the photoconductor, a dustproofing member arranged upstream of an exposure position of the exposure device in a moving direction of the photoconductor, and a cover which supports the exposure device and dustproofing member, wherein said cover pivots on a shaft which is arranged downstream of the exposure position in the moving direction of the photoconductor, and wherein the dustproofing member is structured of an L-shaped member including a first dustproofing section protruding toward the photoconductor from the cover and a second dustproofing section protruding toward the exposure device from the top of the first dustproofing section.

DETAILED DESCRIPTION OF THE INVENTION

The embodiments of the present invention, will be detailed below, however the invention is not limited to the embodiments.

Figure 1:
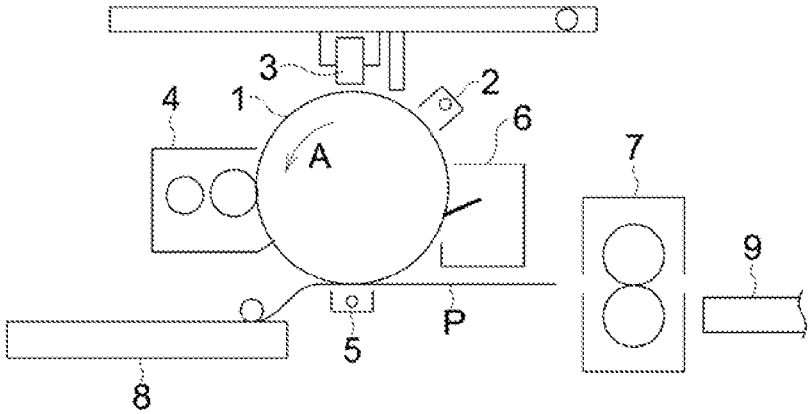
FIG. 1 shows the structure of an image forming apparatus relating to embodiments of the present invention.

FIG. 1 shows the structure of an image forming apparatus of the embodiments of the present invention.

The image forming apparatus, which forms an image on a recording member by an electro-photographic process, is structured of electrical charging device 2, exposure device 3, developing device 4, image transfer device 5, and cleaning device 6, arranged in that order around photoconductor 1, in the rotating direction of photoconductor 1, indicated by arrow A.

At the bottom section of the image forming apparatus, sheet supplying section 8, transfer device 5, fixing device 7 and sheet ejecting section 9 are arranged from the left to the right in that order.

To form the image, photoconductor 1 rotates counterclockwise, as shown by arrow A, a toner image is formed on photoconductor 1 by the operations of electrical charging device 2, exposure device 3 and developing device 4.

In synchronizing the formation of the toner image, recording member P is conveyed from sheet supplying section 8, whereby the toner image on photoconductor 1 is transferred onto recording member P by transfer device 5.

The toner image, carried on recording member P, passes through fixing device 7 to be fixed via heating and pressure.

Recording member P, carrying the fixed image, is ejected onto a tray of sheet-ejection section 3.

Figure 2:
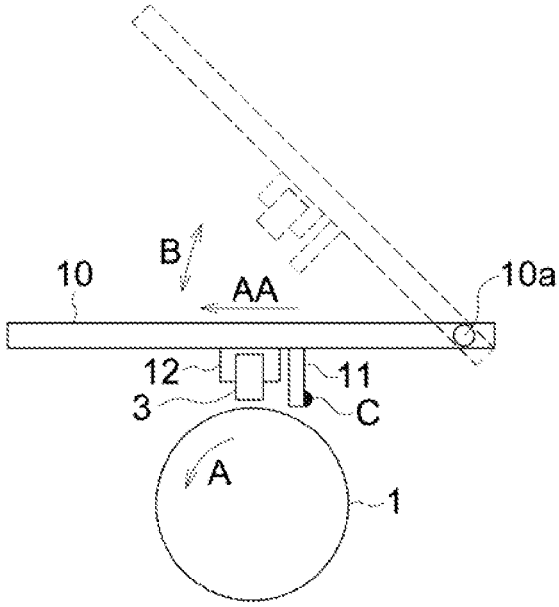
FIG. 2 shows embodiment 1 of the present invention.

FIG. 2 shows embodiment 1 of the present invention, having a structure to prevent dust from landing and accumulating onto exposure device 3.

In FIG. 2, exposure device 3 includes an LED array in which a plurality of LED elements are arranged perpendicular to the moving direction of photoconductor 1, and an optical element array which concentrates the outputted light rays emitted from the LEDs onto the surface of photoconductor 1. Based on driving signals to drive the LEDs, exposure device 3 conducts a dot exposure on photoconductor 1 to form an image on photoconductor 1.

Cover 10, which forms an upper exterior package of the image forming apparatus, is hinged at right end section 10*a*, and can be opened and closed in arrowed directions B by the operation of the operator.

Exposure device 3 is suspended from cover 10 via supporting member 12, and dustproofing member 11 is also suspended from cover 10.

Dustproofing member 11 is mounted upstream of exposure device 3 in the moving direction (which is shown by arrow AA), at the exposure position of photoconductor 1. The bottom of dustproofing member 11 is closer to photoconductor 1 than the bottom of exposure device 3.

During the rotation of photoconductor 1 shown by arrow A, airflows are generated on the surface of photoconductor 1 so as to follow the rotation of photoconductor 1. Any loose dust in the airflow, such as toner particles, are blocked by dustproofing member 11 so that a light emitting surface of exposure device 3 is prevented from being covered by dust.

Hinge 10*a* is mounted upstream of exposure device 3 in the moving direction at the exposure position, of photoconductor 1, that is, hinge 10*a* is mounted upstream of the exposure position, which corresponds to the rotation shown by arrow A, in moving direction AA.

During any maintenance work, cover 10 rotates around hinge 10*a* as shown by arrow B, and changes its position from an operational position shown by solid lines to a non-operational position shown by dashed lines. Exposure device 3 and dustproofing member 11 move with cover 10.

Dust particles "C" tends to accumulate on an upstream edge of dustproofing member 11 in moving direction AA of photoconductor 1. Accumulated dust particles C tends to drop, specifically when cover 10 is opened or closed.

Since cover 10 rotates around hinge 10*a* which is mounted upstream of exposure device 3 in moving direction AA of photoconductor 1, dustproofing member 11 is positioned lower than exposure device 3 when cover 10 opens. Accordingly, dropped dust particles C cannot land onto exposure device 3.

Figure 3:
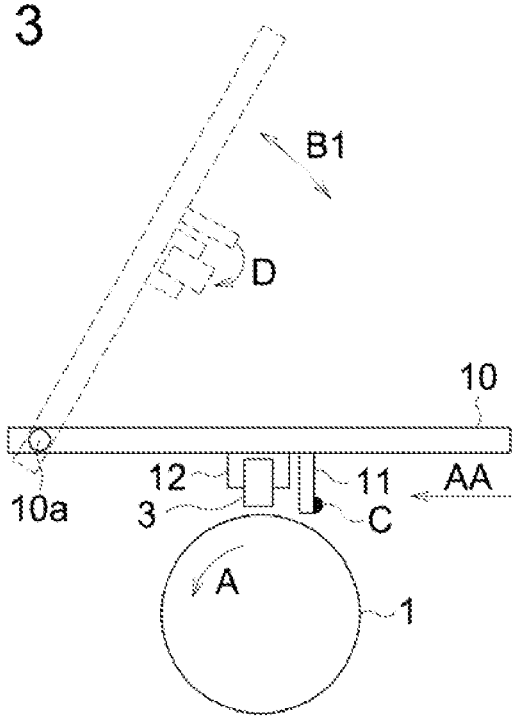
FIG. 3 shows dust which landed on a dustproofing member and then dropped onto an exposure device from the dustproofing member.

The structure of the present embodiment, that is, the structure to prevent exposure device 3 from being covered with dust particles C will now be detailed while comparing it to the structure shown in FIG. 3.

In FIG. 3, cover 10 is rotated in directions B1 around hinge 10*a*, which is mounted downstream of exposure device 3 in rotating direction AA of photoconductor 1, so that cover 10 can be opened or closed as shown arrows B1.

In this structure, when cover 10 is opened, dustproofing member 11 is positioned above exposure device 3.

As a result, dust particles C drop onto the light emitting surface of exposure device 3 as shown by arrow D, and exposure device becomes dusty.

In the embodiment shown in FIG. 2, it is clear that exposure device 3 is effectively prevented from becoming dusty.

Figure 4:
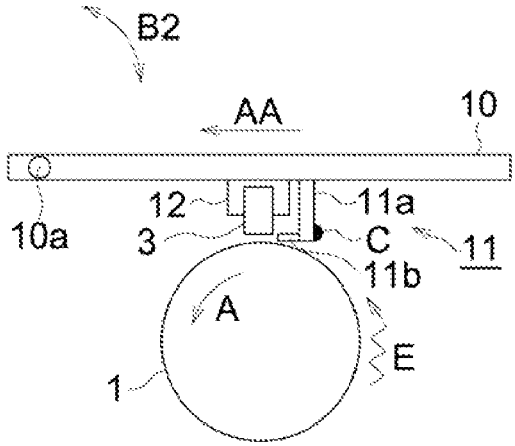
FIG. 4 shows embodiment 2 of the present invention.

FIG. 4 shows embodiment 2 of the present invention.

In the present embodiment, dustproofing member 11 is structured of first dustproofing section 11*a* and second dustproofing section 11*b* which is attached on the bottom end of first dustproofing section 11*a*.

A clearance is formed between the surface of photoconductor 1 and first dustproofing section 11*a*, protruded from cover 10 toward the surface of photoconductor 1, whereby airflow E following the rotation of photoconductor 1 is blocked so that dust particles C are prevented from entering the space in which exposure device 3 exists.

Second dustproofing section 11*b*, protruding from the bottom end of first dustproofing section 11*a* toward the peak of photoconductor 1, prevents dust particles C from entering the space of exposure device 3, which is the same manner as first dustproofing section 11*a*. Further, as will be detailed below, dust particles C landed on dustproofing member 11 are prevented from dropping onto exposure device 3.

In the present embodiment, hinge 10*a* of cover 10 is mounted downstream of exposure device 3 in moving direction AA of photoconductor 1.

The clearance between second dustproofing section 11*b* and photoconductor 1 is narrower than the clearance between exposure device 3 and photoconductor 1.

By such structure of second dustproofing section 11*b*, the airflows, generated by being blocked by an upstream edge of first dustproofing section 11*a*, in moving direction AA of photoconductor 1, smoothly flow between photoconductor 1 and second dustproofing section 11*b*, whereby dust particles C are accumulated on the upstream edge of first dustproofing section 11*a*, but are not accumulated on second dustproofing section 11*b*.

When cover 10 is opened while being upwardly rotated around hinge 10*a* (being a pivot shaft) as shown by arrow B2 in FIG. 4, though dust particles C may drop by an opening movement, dust particles C can be blocked by second dustproofing section 11*b*, so that dust particles C are prevented from landing on exposure device 3.

Figure 5:
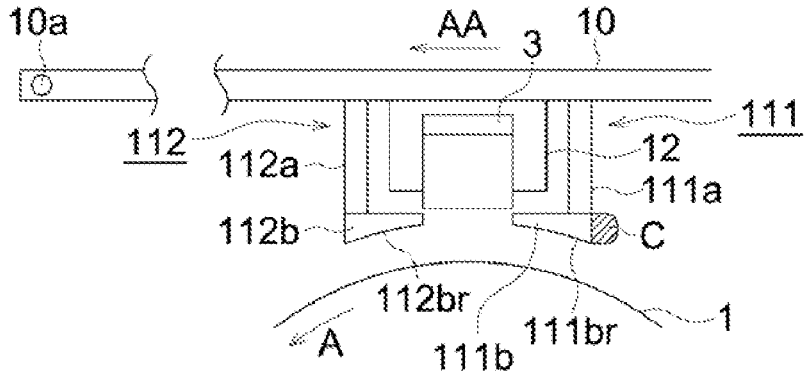
FIG. 5 shows embodiment 3 of the present invention.

FIG. 5 shows embodiment 3 of the present embodiment.

In the present embodiment, on both sides of exposure device 3, that is, in moving direction AA of photoconductor 1, dustproofing member 111 is mounted upstream of exposure device 3, while auxiliary dustproofing member 112 is mounted downstream of exposure device 3. Dustproofing member 111 is structure of first dustproofing section 111*a* and second dustproofing section 111*b*, while auxiliary dustproofing member 112 is structure of first dustproofing section 112*a* and second dustproofing section 112*b*.

Further, surfaces 111*br* and 112*br* of second dustproofing sections 111*b* and 112*b*, each opposing photoconductor 1, are concavely formed to be concentric with the surface of photoconductor 1.

Due to the above structures of second dustproofing sections 111*b* and 112*b*, dust particles C land at the upstream edge of second dustproofing section 111*b* of dustproofing member 111, however dust particles C are prevented from landing on other sections.

Further, when cover 10 is opened while being upwardly rotated around hinge 10*a* which is mounted downstream of exposure device 3 in moving direction AA, though dust particles C may drop from dustproofing member 111, dust particles C can be blocked by second dustproofing sections 111*b* and 112*b*, so that dust particles C are prevented from landing at exposure device 3.

In the embodiment shown in FIG. 5, since other than the light emitting section are hermetically closed by dustproofing member 111 and auxiliary dustproofing member 112, dustproof effect for exposure device 3 is extremely high, which is advantageous.

Figure 6:
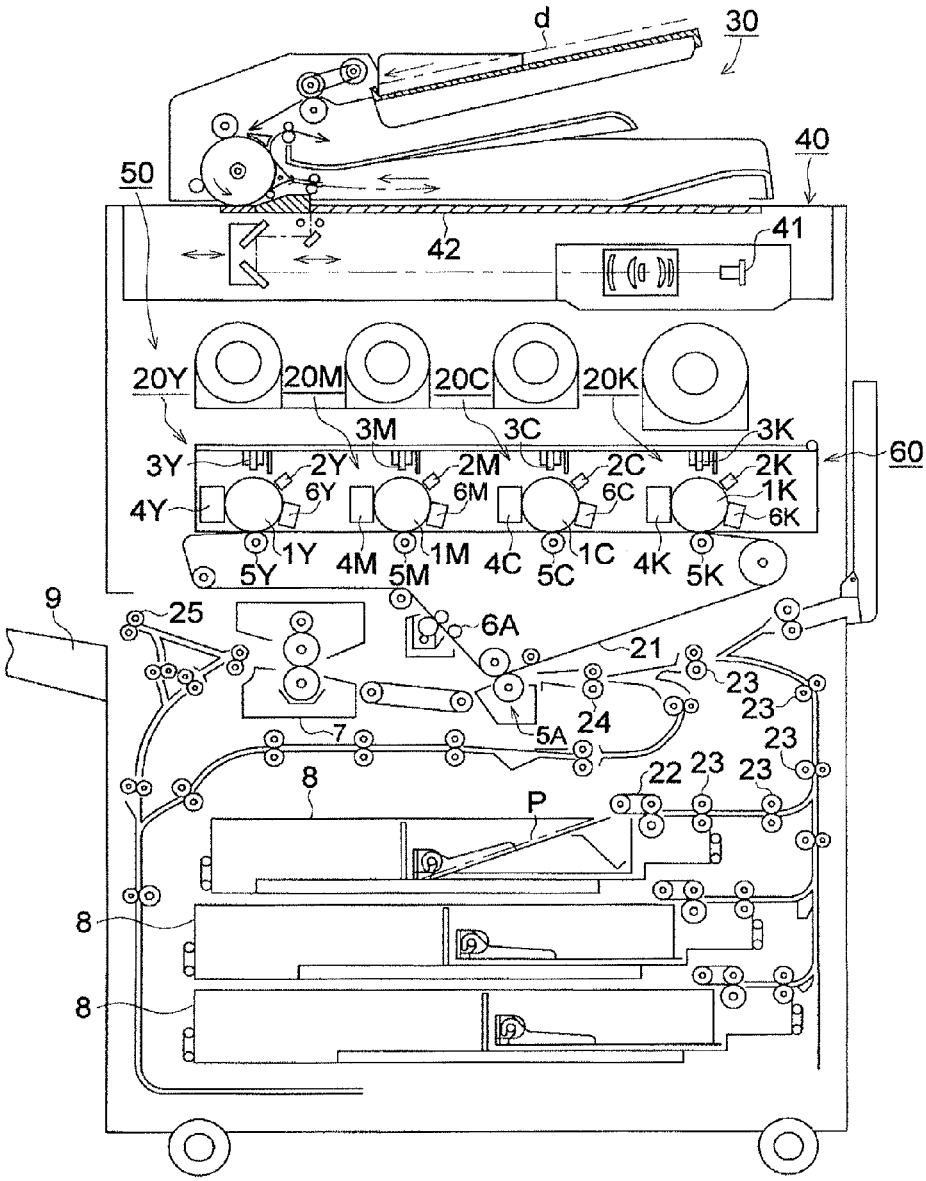
FIG. 6 shows a color image forming apparatus relating to embodiment 4.

FIG. 6 shows a color image forming apparatus relating to embodiment 4.

The present image forming apparatus is an color image forming apparatus to form a color image on recording sheet P, including automatic document feeding device 30 which feeds a document one by one to a document reading position, image reading section 40, and image forming section 50.

Image reading section 40 reads out document "d", conveyed by automatic document feeding device 30 or placed on document platen 42, by reading elements 41 to form image data.

Image forming section 50 includes a plurality of processing units 20Y, 20M, 20C and 20K, intermediate transfer body 21, primary transfer sections 5Y, 5M, 5C and 5K, secondary transfer section 5A, fixing device 7, a plurality of recording sheets storing section, and sheet ejection tray 9.

Processing unit 20Y to form an yellow image is structured of photoconductor 1Y, and electrical charging device 2Y, exposure device 3Y, developing device 4Y and cleaning unit 6Y, each mounted around photoconductor 1Y.

Processing unit 20M to form a magenta image is structured of photoconductor 1M, and electrical charging device 2M, exposure device 3M, developing device 4M and cleaning unit 6M, each mounted around photoconductor 1M.

Processing unit 20C to form a cyan image is structured of photoconductor 1C, and electrical charging device 2C, exposure device 3C, developing device 4C and cleaning unit 6C, each mounted around photoconductor 1C.

Processing unit 20K to form a black image is structured of photoconductor 1K, and electrical charging device 2K, exposure device 3K, developing device 4K and cleaning unit 6K, each mounted around photoconductor 1K.

Intermediate transfer body 21, being a rotatable belt, is entrained about a plurality of rollers. Fixing device 7 has a heated roller to fix the image on sheet P.

Each color image, formed by processing unit 20Y, 20M, 20C and 20K, is sequentially transferred onto rotating intermediate transfer body 21 by primary transfer sections 5Y, 5M, 5C and 5K, so that the color image is formed.

Recording sheet P, stored in recording sheet storing section 8 structured of a plurality of trays, is conveyed one by one by sheet supplying rollers 22, and is conveyed to paired registration rollers 24, which are in the stopped condition, via paired sheet supplying rollers 23. Sheet P temporally stops there, after the leading edge of sheet P and the toner image on transfer body 21 precisely meet each other, paired registration rollers 24 start the rotation so that sheet P is conveyed to secondary transfer section 5A, where a color image is formed on recording sheet P (which is a secondary transfer operation). Sheet P, on which the color image has been transferred, is heated and pressured at fixing device 7, so that the color image is fixed on sheet P. Then, sheet P is ejected by paired ejection rollers 25 onto sheet ejection tray 9 exterior the apparatus.

After the color image was transferred onto recording sheet P by secondary transfer section 5A, intermediate transfer body 21, from which sheet P was separated by a sharp angled conveyance, is cleaned by cleaning device 6A so that residual toner is removed.

Processing units 20Y, 20M, 20C and 20K are integrally formed to be a drawer unit 60.

Drawer unit 60 can be pulled toward the operator, which is the depth direction of FIG. 6.

Figure 7:
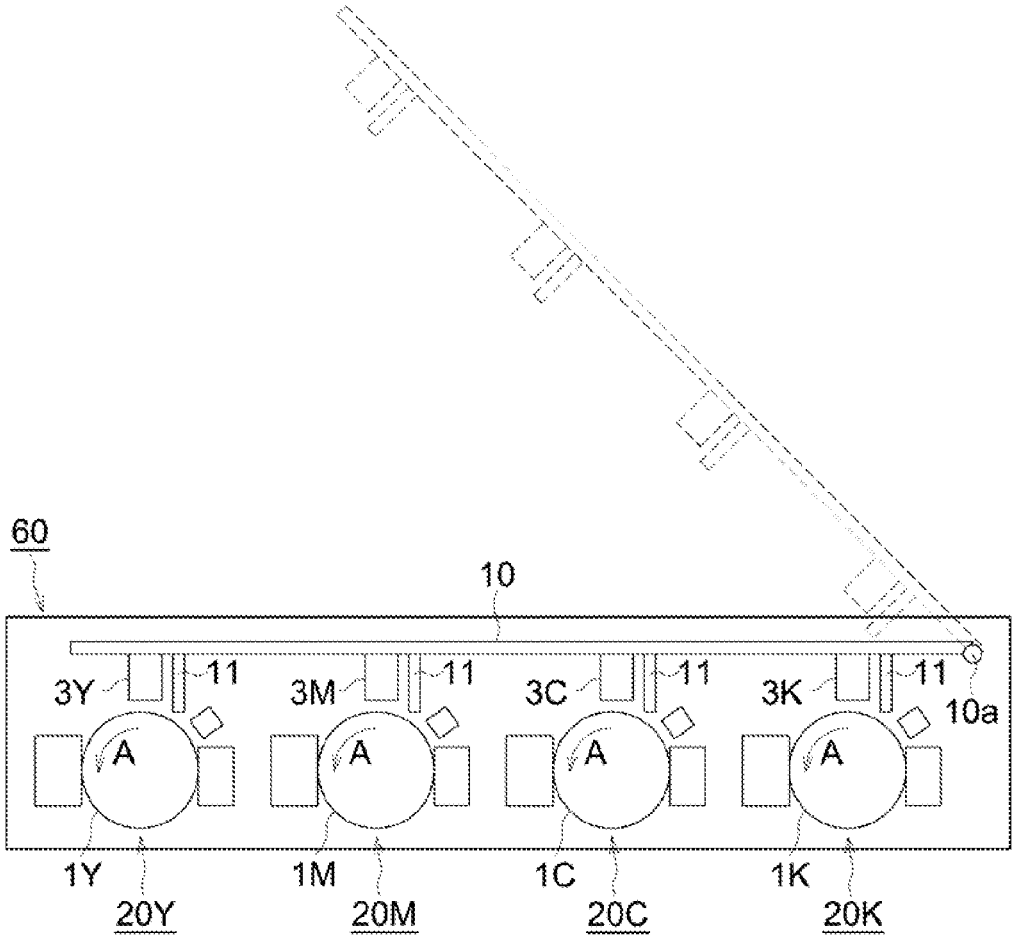
FIG. 7 shows drawer unit 60.

FIG. 7 shows drawer unit 60.

After drawer unit 60 is pulled out from the image forming apparatus, cover 10 can be rotated around hinge 10*a* to open upwardly, whereby processing unit 20Y, 20M, 20C and 20K are checked for the maintenance.

Hinge 10*a* of cover 10 exists more upstream than exposure device 3Y, 3M, 3C and 3K in the moving direction at the exposure positions of photoconductors 1Y, 1M, 1C and 1K.

Exposure devices 3Y, 3M, 3C and 3K of processing units 20Y, 20M, 20C and 20K are structured of LED arrays and optical element arrays, which are the same as the image forming apparatus in FIG. 1.

In the moving direction at the exposure positions of photoconductors 1Y, 1M, 1C and 1K, dustproofing members 11, arranged upstream of exposure devices 3Y, 3M, 3C and 3K respectively, can prevent dust particles C from landing on the light emitting surfaces of exposure devices 3Y, 3M, 3C and 3K. Further, as detailed for the image forming apparatus of FIG. 1, when cover 10 opens, dust particles C, landed on dustproofing members 11, are prevented from dropping onto exposure devices 3Y, 3M, 3C and 3K.

Figure 8:
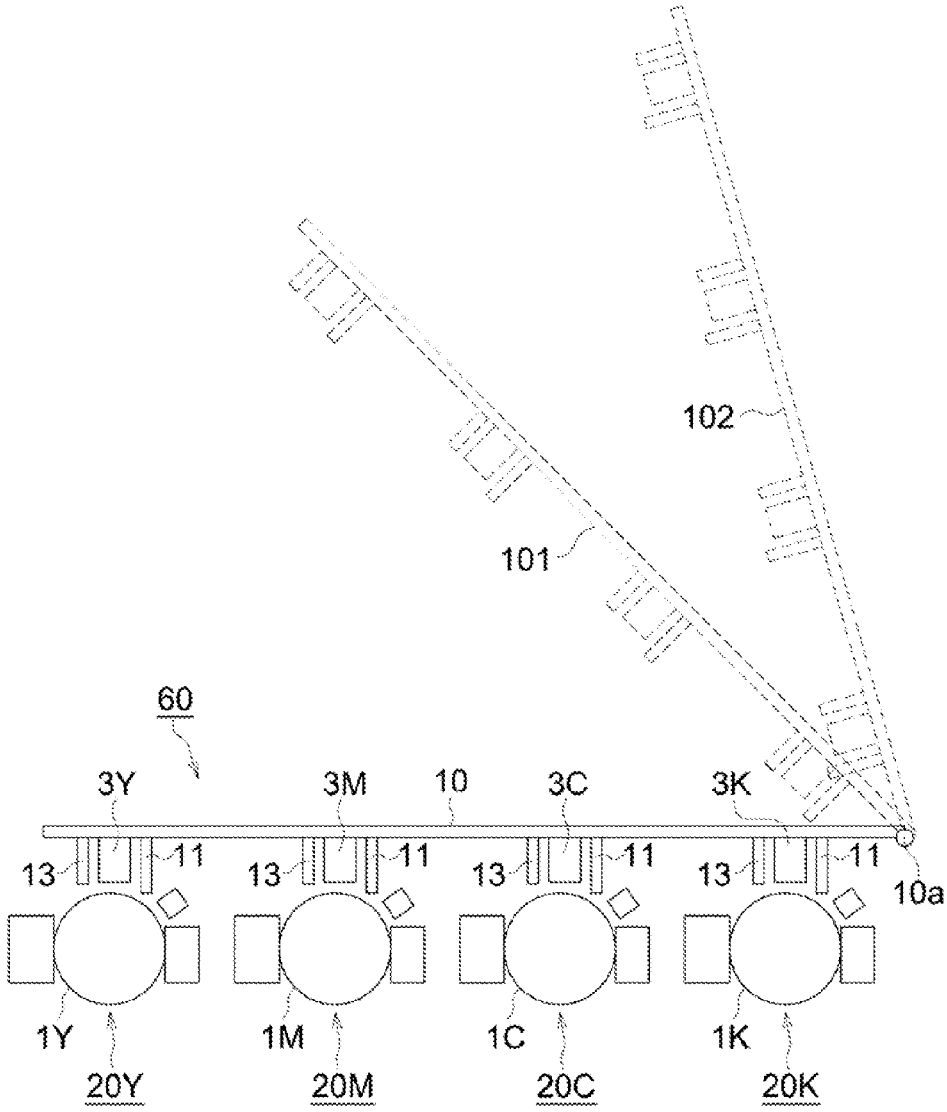
FIG. 8 shows embodiment 5 of the present invention.

FIG. 8 shows embodiment 5 of the present invention.

In embodiment 5, dustproofing member 11 and auxiliary dustproofing member 13 are mounted to sandwich exposure device 3.

The clearance between the top of auxiliary dustproofing member 13 and surface of photoconductor 1 is greater than the clearance between the top of dustproofing member 11 and the surface of photoconductor 1.

Accordingly, while photoconductor 1 rotates, dust do not land on auxiliary dustproofing member 13.

As shown in FIG. 8, dustproofing member 11 and auxiliary dustproofing member 13 are mounted for processing units 20Y, 20M, 20C and 20K, respectively.

As shown in FIG. 8, cover 10 opens up to dashed lined position 101, or further upper to dashed lined position 102.

When cover 10 rotates up to position 102, cover 10 is approximately vertical, whereby exposure device 3M comes lower than dustproofing member 11 of exposure device 3Y, exposure device 3C comes lower than dustproofing member 11 of exposure device 3M, and exposure device 3K comes lower than dustproofing member 11 of exposure device 3C.

As results, dust particles C may drop from dustproofing members 11 to exposure devices 3M, 3C and 3K.

Further, when cover 10 opens, auxiliary dustproofing members 13 prevent dust particles C, which drop from upper-positioned dustproofing member 11, from landing at lower-positioned exposure device 3.

Figure 9:
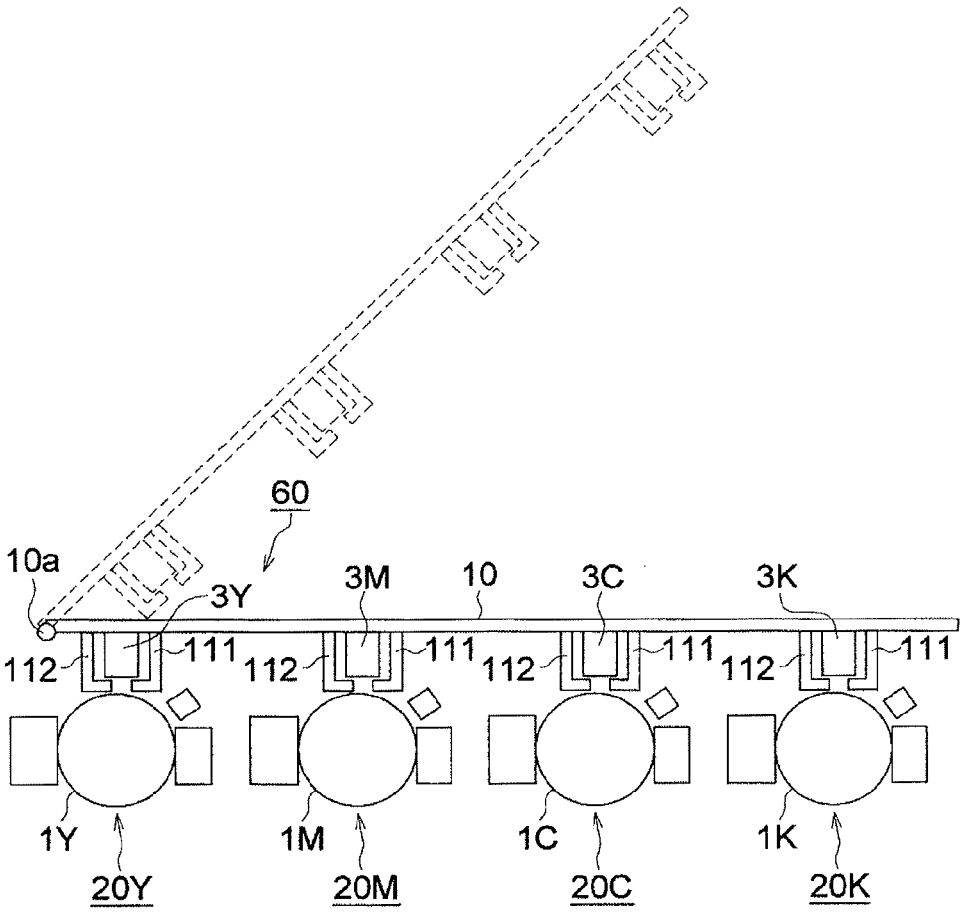
FIG. 9 shows embodiment 6 of the present invention.

FIG. 9 shows embodiment 6 of the present invention.

In the present embodiment, cover 10 rotates around hinge 10*a* which is mounted at downstream of the exposure devices 3Y, in the moving direction of photoconductor 1Y at the exposure position.

Further in the present invention, dustproofing member 111 and auxiliary dustproofing member 112 are provided at both sides of each of exposure devices 3Y, 3M, 3C and 3K.

Still further, dustproofing member 111 includes first dustproofing section 111*a* and second dustproofing section 111*b*, while auxiliary dustproofing member 112 includes first auxiliary dustproofing section 112*a* and second auxiliary dustproofing section 112*b*.

As described in FIG. 5, though hinge 10*a* of cover 10 is provided downstream of the moving direction of photoconductor 1, due to dustproof effects of first dustproofing sections 111*a* and 112*a*, as well as second dustproofing sections 111*b* and 112*b*, while the operator opens or closes cover 10, dust particles C are effectively prevented from landing at the light emitting sections of exposure devices 3Y, 3M 3C and 3K.

What is claimed is:

1. An image forming apparatus, comprising:

plural photoconductor drums, each of which being rotatable in a moving direction around a rotation axis thereof, wherein on each of the plural photoconductor drums, a toner image corresponding to one of yellow, magenta, cyan, and black colors is formed, respectively;

plural exposure devices, each of which exposing the toner image formed on each photoconductor drum corresponding to one of the yellow, magenta, cyan, and black colors, respectively;

plural sets of dust proofing members, each set including a first dust proofing member arranged at an upstream side of an exposure position of each corresponding exposure device and a second dust proofing member arranged at a downstream side of the exposure position in the moving direction of each corresponding rotating photoconductor drum, each set corresponding to one of the yellow, magenta, cyan, and black colors, respectively; and a cover which integrally supports the plural exposure devices and the plural sets of dust proofing members, wherein the cover, the plural photoconductor drums, the plural sets of dust proofing members, and the plural exposure devices are formed in a single unit, wherein the cover opens and closes for access to the plural sets of dust proofing members, wherein the first dust proofing member includes an L-shaped structure including a first dust proofing section protruding toward each corresponding photoconductor drum from the cover and a second dust proofing section protruding toward each corresponding exposure device from the top of the first dust proofing section, wherein a surface of the second dust proofing section is concentric with a surface of each corresponding photoconductor drum, wherein the second dust proofing member includes an L-shaped structure including a third dust proofing section protruding toward each corresponding photoconductor drum from the cover and a fourth dust proofing section protruding toward each corresponding exposure device from the top of the third dust proofing section, wherein a surface of the fourth dust proofing section is concentric with the surface of each corresponding photoconductor drum, and wherein the second dust proofing section includes a first end portion located adjacent an upstream edge of the corresponding exposure device and the fourth dust proofing section includes a second end portion located adjacent a downstream edge of the corresponding exposure device, the first and second end portions protruding toward one another and forming an open space between the corresponding exposure device and the corresponding photoconductor drum along an optical path of the corresponding exposure device.

2. An image forming apparatus comprising:

plural photoconductor drums, each of which being rotatable in a rotating direction around a rotation axis thereof, wherein on each of the plural photoconductor drums, a toner image corresponding to one of yellow, magenta, cyan, and black colors is formed, respectively; and plural exposure units, each opposing to an outer surface of each corresponding photoconductor drum corresponding to one of the yellow, magenta, cyan, and black colors, respectively, each exposure unit having:

an exposure device to expose the outer surface of each corresponding photoconductor drum;

plural dust proofing members including:

a first dust proofing member having an L-shaped structure and arranged at an upstream side of each corresponding exposure device with respect to the rotating direction of each corresponding photoconductor drum, the first dust proofing member including a first dust proofing wall extending against the outer surface of each corresponding photoconductor drum and a second dust proofing wall extending from the first dust proofing wall toward a downstream side with respect to the rotating direction of each corresponding photoconductor drum; and a second dust proofing member having an L-shaped structure and arranged at the downstream side of each corresponding exposure device with respect to the rotating direction of each corresponding photoconductor drum, the second dust proofing member including a third dust proofing wall extending against the outer surface of each corresponding photoconductor drum and a fourth dust proofing wall extending from the third dust proofing wall toward the upstream side with respect to the rotating direction of each corresponding photoconductor drum;

wherein each of the second and fourth dust proofing walls has a curved surface concentric with a surface of each corresponding photoconductor drum; and a cover which integrally supports the plural exposure units and the plural dust proofing members, wherein the cover, the plural photoconductor drums, the plural dust proofing members, and the plural exposure units are formed in a single unit, and wherein the second dust proofing wall includes a first end portion located adjacent an upstream edge of the corresponding exposure device and the fourth dust proofing wall includes a second end portion located adjacent a downstream edge of the corresponding exposure device, the first and second end portions protruding toward one another and forming an open space between the corresponding exposure device and the corresponding photoconductor drum along an optical path of the corresponding exposure device.

* * * * *